US011944131B2

(12) United States Patent
Gusse et al.

(10) Patent No.: US 11,944,131 B2
(45) Date of Patent: Apr. 2, 2024

(54) PERSONAL SMOKING DEVICE ACCESSORY

(71) Applicants: Zachary Michael Gusse, Raleigh, NC (US); Amanda Carol Parrish, Raleigh, NC (US)

(72) Inventors: Zachary Michael Gusse, Raleigh, NC (US); Amanda Carol Parrish, Raleigh, NC (US)

( * ) Notice: Subject to any disclaimer, the term of this patent is extended or adjusted under 35 U.S.C. 154(b) by 93 days.

(21) Appl. No.: 17/688,404

(22) Filed: Mar. 7, 2022

(65) Prior Publication Data

US 2023/0276843 A1 Sep. 7, 2023

(51) Int. Cl.
*A24F 9/00* (2006.01)
*A24F 13/18* (2006.01)

(52) U.S. Cl.
CPC ..... *A24F 9/00* (2013.01); *A24F 13/18* (2013.01)

(58) Field of Classification Search
CPC ..... A24F 9/00; A24F 13/18
USPC ..... 131/256
See application file for complete search history.

(56) References Cited

U.S. PATENT DOCUMENTS

2008/0111037 A1* 5/2008 Carnevali ..... F16B 47/00 248/206.2
2015/0351453 A1* 12/2015 Cruz ..... A24F 9/00

* cited by examiner

*Primary Examiner* — Christopher M Rodd
*Assistant Examiner* — Ronnie Kirby Jordan
(74) *Attorney, Agent, or Firm* — NK Patent Law

(57) ABSTRACT

A device for use while smoking includes a sleeve defining an opening on a first end. The opening is contiguous with a recess defined therein. The recess is configured for slideably receiving a smoking accessory therein. An extinguisher is positioned on a second end. The extinguisher defines a resilient seal that is configured for being received above a smoking substance that is under flame to extinguish the smoking substance. The device has a first mode of operation in which stowage of a smoking accessory is received within the sleeve, a second mode of operation in which the device is engaged with a proximal surface by engagement of the resilient seal with the proximal surface, and a third mode of operation in which the extinguisher carried by the sleeve is used to extinguish a flame.

5 Claims, 6 Drawing Sheets

PERSONAL SMOKING DEVICE ACCESSORY

TECHNICAL FIELD

The presently disclosed subject matter is directed towards a sleeve for use with smoking, the sleeve having a first mode of operation in which stowage of a smoking accessory is received within the sleeve, a second mode of operation in which the device is engaged with a proximal surface, and a third mode of operation in which an extinguisher carried by the sleeve is used to extinguish a flame.

BACKGROUND

Many persons smoke for recreational or medicinal uses. Sometimes this smoking occurs in the form of a tobacco or similar product that is contained within a rolled paper product, and other times, raw or processed tobacco or other products are placed into a smoking structure, such as a pipe.

This necessarily requires several hands for the user. The user must light the tobacco or other product and hold the smoking structure in another hand. The user must then place the lighter down. After enjoying the smoking product, the smoking product must be extinguished or it can continue to burn or smolder for a while, and even begin burning again. This causes material that could otherwise be enjoyed at a later date to continue to burn and this is thus not cost efficient. Extinguishing the fire can thus take time, and one cannot do it by adding water, as an example, as it ruins the smoking product. Some users may try to extinguish the product by placing their hand over the smoldering product, however, this risks burning the user's hand and makes their hand smell like the product. Other methods include using a bottle cap, coin, or similar to try and cover over the chamber/cup of the smoking accessory. Left to continue burning or smoldering, second hand smoke and associated smells becomes a problem within the environment.

Accordingly, a need exists for a manner to help users when smoking.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

Disclosed herein is a device for use while smoking includes a sleeve defining an opening on a first end. The opening is contiguous with a recess defined therein. The recess is configured for slideably receiving a smoking accessory therein. An extinguisher is positioned on a second end. The extinguisher defines a resilient seal that is configured for being received above a smoking substance that is under flame to extinguish the smoking substance. The device has a first mode of operation in which stowage of a smoking accessory is received within the sleeve, a second mode of operation in which the device is engaged with a proximal surface by engagement of the resilient seal with the proximal surface, and a third mode of operation in which the extinguisher carried by the sleeve is used to extinguish a flame.

According to one or more embodiments, the sleeve defines a semi oblong cross-section.

According to one or more embodiments, the smoking accessory is a lighter, and receipt of the lighter within the sleeve causes an interference engagement between the lighter and the sleeve to secure the lighter therein.

According to one or more embodiments, a top of the lighter extends above the sleeve such that a striker of the lighter can be used while the lighter is received within the sleeve.

According to one or more embodiments, the extinguisher defines a concave cross-section.

According to one or more embodiments, the extinguisher is a suction cup.

According to one or more embodiments, a tab extends from the suction cup for providing disengaging forces to the suction cup when the suction cup is engaged with the proximal surface.

According to one or more embodiments, the suction cup defines a cross-section that is larger than a cross-section of the sleeve.

According to one or more embodiments, the smoking substance is received within a chamber/bowl of a smoking pipe.

BRIEF DESCRIPTION OF THE DRAWINGS

The foregoing, as well as the following Detailed Description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed.

The embodiments illustrated, described, and discussed herein are illustrative of the present invention. As these embodiments of the present invention are described with reference to illustrations, various modifications or adaptations of the methods and or specific structures described may become apparent to those skilled in the art. It will be appreciated that modifications and variations are covered by the above teachings and within the scope of the appended claims without departing from the spirit and intended scope thereof. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

DETAILED DESCRIPTION

Figure 1:
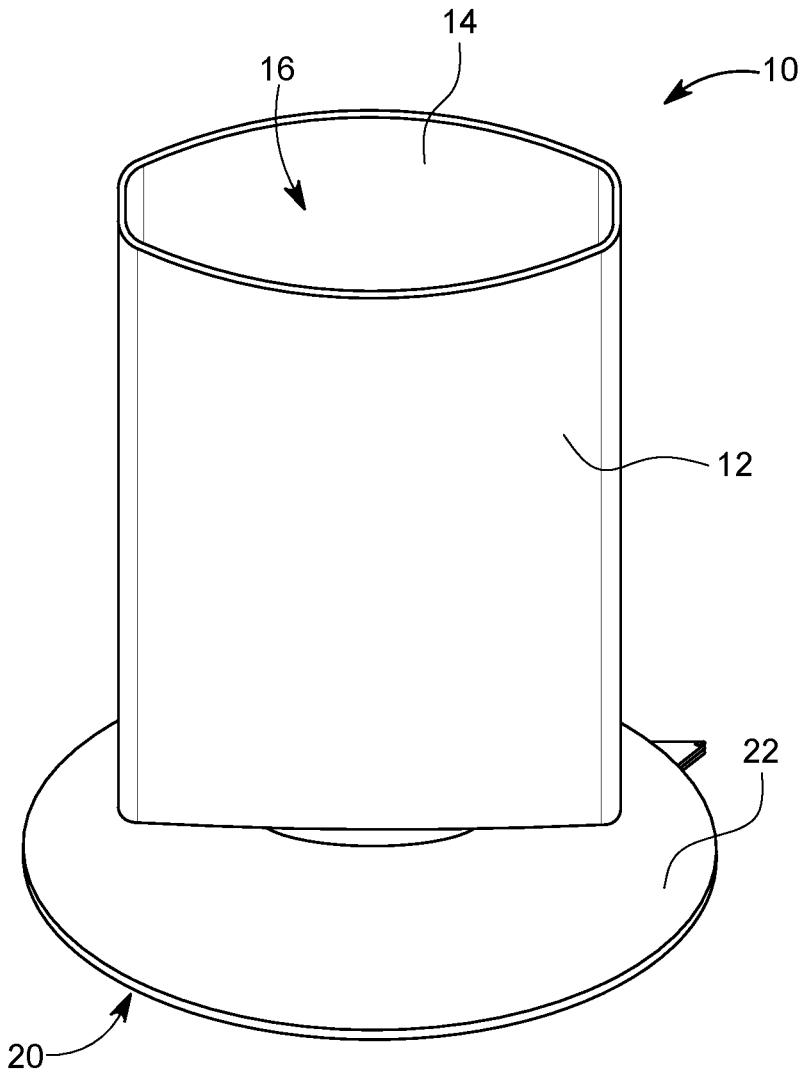
FIG. 1 is a perspective view of a device for use while smoking according to one or more embodiments.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the presently disclosed subject matter.

A device for use while smoking is generally designated as 10. The device 10 includes a sleeve 12 that defines an opening 14 on a first end. The opening 14 is contiguous with a recess 16 defined therein. The recess 16 is configured for slideably receiving a smoking accessory therein. The smoking accessory will be described further herein.

An extinguisher 20 is positioned on a second end. The extinguisher 20 defines a resilient seal 22 that is configured for being received above a smoking substance 2 that is under flame or otherwise burning to extinguish the smoking substance 2. The extinguisher 20 may be any resilient member capable of interfacing with a surface of a smoking object to extinguish a flame. In one or more embodiments, the extinguisher is a suction cup 24. In another embodiment, a tab 26 extends from the suction cup 24 for providing disengaging forces to the suction cup 24 when the suction cup 24 is engaged with the proximal surface. The suction cup 24 may define a cross-section that is larger than a cross-section of the sleeve 12. In this manner, the suction cup 24 provides stability to the sleeve 12 by having a relatively wide base.

Figure 2:
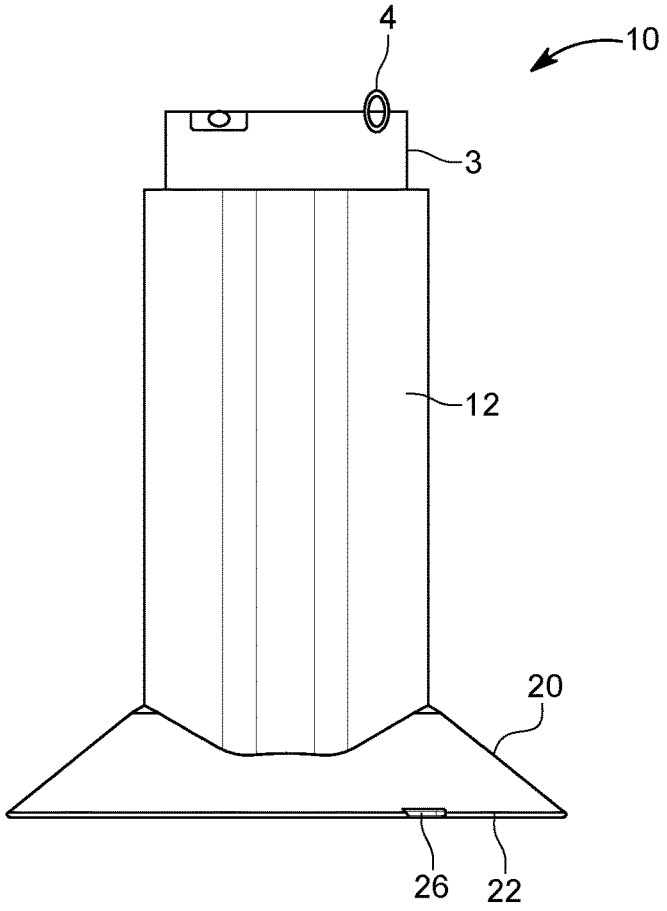
FIG. 2 is a side view of the device, where a smoking accessory is received within a sleeve of the device according to one or more embodiment disclosed herein.
Figure 3:
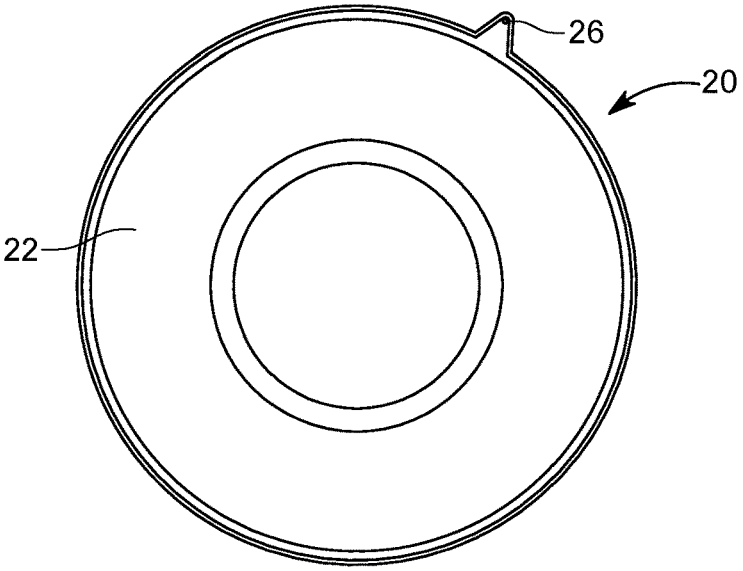
FIG. 3 is a bottom view of the device, where an extinguisher carried by the device is well-illustrated according to one or more embodiments disclosed herein.

The device 10 defines a first mode of operation in which stowage of a smoking accessory is received within the sleeve 12. This is well illustrated in FIG. 2. The smoking accessory may be illustrated as a lighter 3. As illustrated, a top of the lighter 3 extends above the sleeve 12 such that a striker 4 of the lighter 3 can be used while the lighter 3 is received within the sleeve 12. In this manner, the lighter 3 is still fully functional and usable while in the stowed mode of operation.

Figure 4:
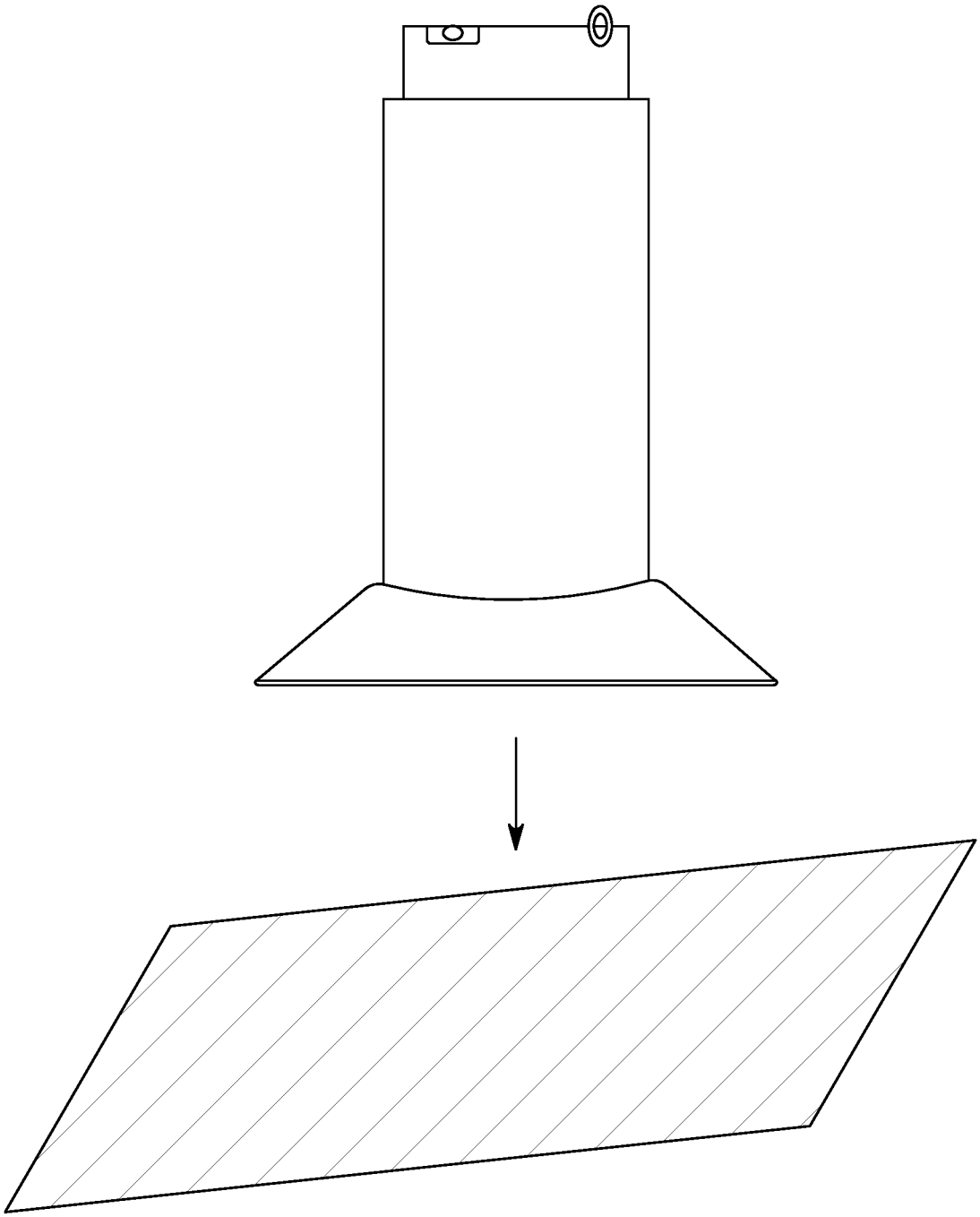
FIG. 4 shows the device being positioned relative to a proximal surface according to one or more embodiment disclosed herein. The device is configured for engaging with the proximal surface in a mode of operation to provide for secure stowage of the device.

As illustrated in FIG. 4, a second mode of operation is depicted in which the device 10 is engaged with a proximal surface, such as a table top, by engagement of the resilient seal 22 with the proximal surface. In this manner, during a smoking activity, the device 10 can be selectively and fixedly engaged about the table top or other structure, so that it is easy to retrieve, and cannot be misplaced by falling out of the user's pocket or similar.

Figure 5A:
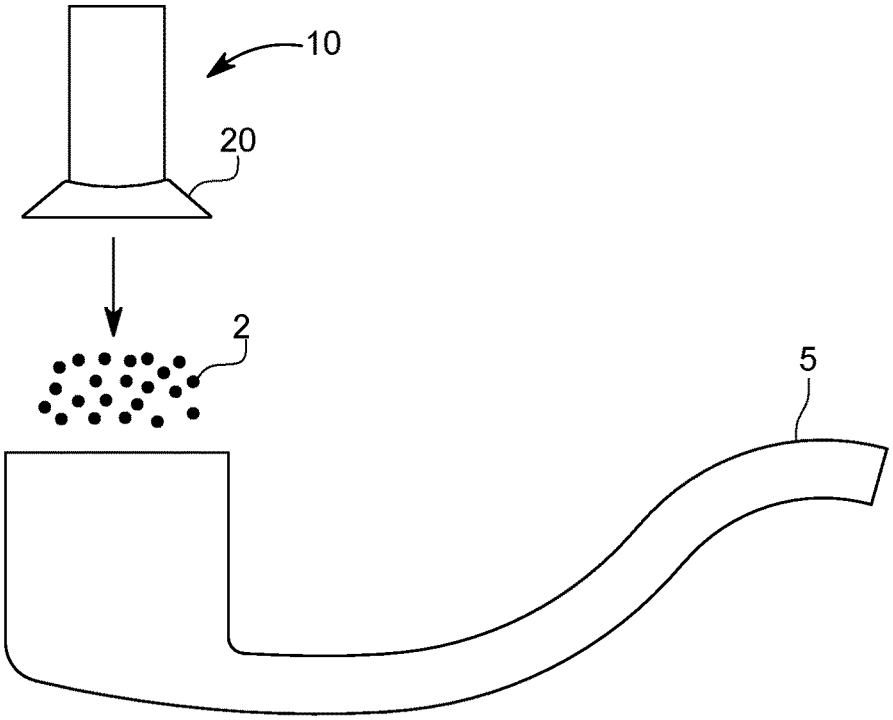
FIG. 5A shows the device being positioned relative to a smoking substance that is lit according to one or more embodiments disclosed herein. As illustrated, a pipe is shown and the chamber/bowl of the pipe includes a lit material.
Figure 5B:
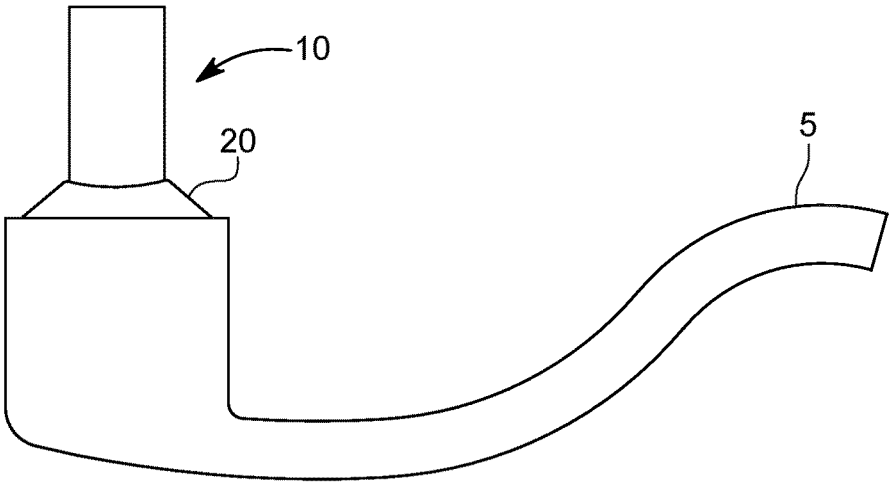
FIG. 5B shows the device where the extinguisher is engaged with the chamber/bowl of the pipe to extinguish the flame therein according to one or more embodiments disclosed herein and FIG. 6 and FIG. 7 illustrate a bottom and top facing perspective view of an alternate embodiment of the device according to one or more embodiments disclosed herein.
Figure 6:
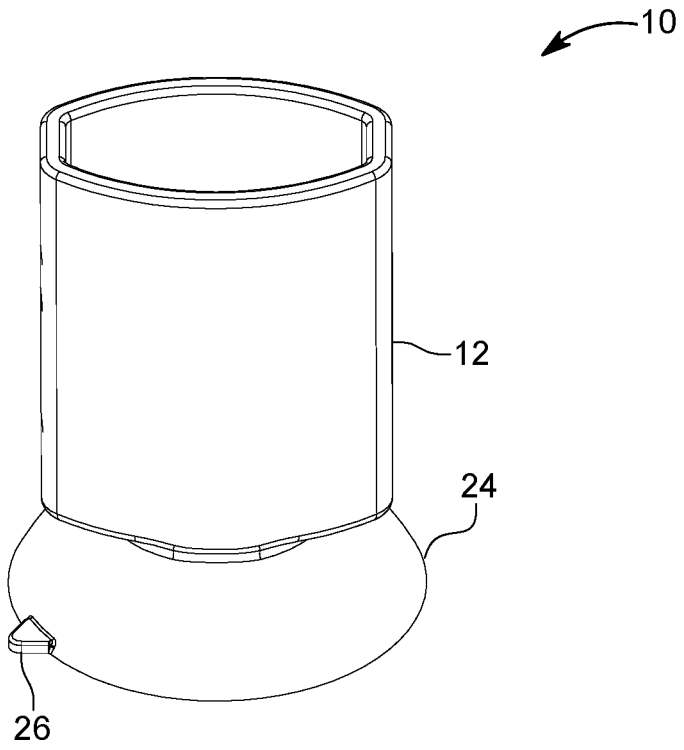
Figure 7:
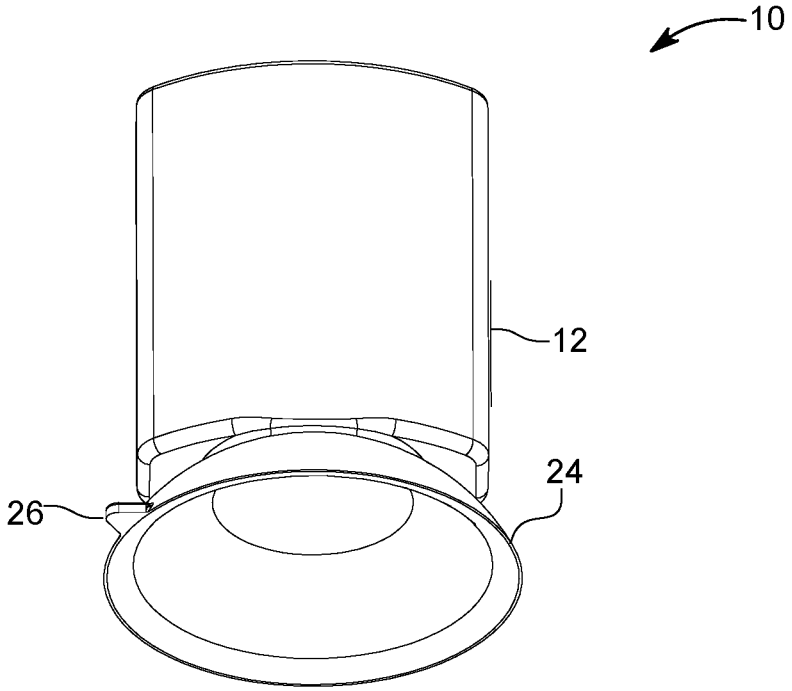

As illustrated in FIG. 5A and FIG. 5B, a third mode of operation is provided in which the extinguisher 20 is used to extinguish a flame. FIG. 5A and FIG. 5B are sequential to each other, with FIG. 5B showing the device 10 positioned into engagement with a pipe 5. In the position illustrated in FIG. 5B, the extinguisher 20, namely suction cup 24, is shown engaged with a periphery of the tobacco portion of pipe 5. The extinguisher 20 is positioned proximal the pipe 5 until the fire is completely out by devoiding the tobacco product of oxygen needed to burn.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

These and other changes can be made to the disclosure in light of the above Detailed Description. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

What is claimed:

1. A device for use while smoking, the device comprising:

a rectangular-shaped sleeve comprising an opening and a recess, wherein the opening of the rectangular-shaped sleeve defines a first end, wherein the opening is contiguous with a recess defined therein; and an extinguisher positioned on a second end, wherein the extinguisher defines a resilient seal that is configured for being received above a smoking substance that is under flame to extinguish the smoking substance, wherein the extinguisher includes a concave top;

wherein a bottom surface of the rectangular-shaped sleeve is in contact with the concave top of the extinguisher;

wherein the rectangular-shaped sleeve includes a lighter positioned within the recess, wherein a top portion of the lighter extends above the first end, wherein the top portion of the lighter includes a striker, wherein a bottom of the lighter is in contact with a bottom of the recess; and wherein the extinguisher includes a suction cup that defines a second end, wherein the suction cup has a cross-section that is larger than a cross-section of the rectangular-shaped sleeve, wherein the suction cup includes a tab component, wherein the tab component extends away from the suction cup, wherein the suction cup is configured to interface with a surface of a smoking object, wherein, once connected to the surface of the smoking object, the suction cup is operable to extinguish a frame, wherein the suction cup is further operable to attach to an external surface, wherein, once the suction cup is attached to an external surface, the tab component is operable to apply a disengaging force to the suction cup to remove the suction cup from the external surface.

2. The device according to claim 1, wherein the rectangular-shaped sleeve defines a semi oblong cross-section.

3. The device according to claim 1, wherein the smoking substance is received within a chamber/bowl of a smoking pipe, wherein the chamber/bowl of the smoking pipe is a circular shape, wherein the extinguisher engages an entire circumference of an interior wall of the chamber/bowl of the smoking pipe.

4. A device for use while smoking, the device comprising:

a rectangular-shaped sleeve comprising an opening and a recess; and an extinguisher comprising a suction cup, wherein the suction cup includes a concave top surface;

wherein the opening of the rectangular-shaped sleeve defines a first end, wherein the opening is contiguous with the recess defined therein, wherein the rectangular-shaped sleeve includes a lighter positioned within the recess, wherein a top portion of the lighter extends above the first end, wherein the top portion of the lighter includes a striker, wherein a bottom of the lighter is in contact with a bottom of the recess;

wherein a portion of the bottom of the rectangular-shaped sleeve is in contact with the concave top surface of the suction cup, wherein a portion of the rectangular-shaped sleeve is not in contact with the concave top surface of the suction cup; and wherein the suction cup defines a second end, wherein the suction cup has a cross-section that is larger than a cross-section of the rectangular-shaped sleeve, wherein the suction cup includes a tab component, wherein the tab component extends away from the suction cup, wherein the suction cup is configured to contact a surface of a smoking object, wherein, once connected to the surface of the smoking object, the suction cup is operable to extinguish a flame, wherein the suction cup is further operable to attach to an external surface, wherein, once the suction cup is attached to an external surface, the tab component is operable to apply a disengaging force to the suction cup to remove the suction cup from the external surface.

5. The device according to claim 4, wherein the suction cup is positioned within a chamber/bowl of a smoking pipe, wherein the chamber/bowl of the smoking pipe is a circular shape, wherein the suction cup engages an entire circumference of an interior wall of the chamber/bowl of the smoking pipe.

* * * * *